US007918236B2

(12) United States Patent
Elder

(10) Patent No.: US 7,918,236 B2
(45) **Date of Patent: *Apr. 5, 2011**

(54) PORTABLE SUN AND WEATHER SHELTER

(76) Inventor: James Christopher Elder, Carrollton, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/862,653

(22) Filed: Aug. 24, 2010

(65) Prior Publication Data

US 2010/0319738 A1 Dec. 23, 2010

Related U.S. Application Data

(63) Continuation of application No. 12/466,476, filed on May 15, 2009, now Pat. No. 7,793,674.

(60) Provisional application No. 61/131,367, filed on Jun. 9, 2008.

(51) Int. Cl.
*A45B 25/18* (2006.01)
*A45B 25/20* (2006.01)

(52) U.S. Cl. ..... 135/33.2; 135/33.7; 135/16

(58) Field of Classification Search ..... 135/15.1, 135/16, 25.4, 33.2, 33.4, 33.7, 98
See application file for complete search history.

(56) References Cited

U.S. PATENT DOCUMENTS

| | | | |
|---|---|---|---|
| 1,581,843 | A | 4/1926 | Little, Sr. |
| 1,774,909 | A | 9/1930 | Wells |
| 2,024,105 | A | 12/1935 | Landman |
| 2,934,076 | A | 4/1960 | Fulke |
| 3,456,661 | A | 7/1969 | Farley |
| 4,086,931 | A | 5/1978 | Hall |
| 4,449,542 | A | 5/1984 | McSwain et al. |
| 4,499,133 | A | 2/1985 | Prince |
| D294,538 | S | 3/1988 | De Marr |
| 4,821,353 | A | 4/1989 | Neri |
| 4,958,652 | A | 9/1990 | Maya |
| 5,551,464 | A | 9/1996 | Kelly |
| 5,692,720 | A | 12/1997 | Griggs |
| 5,806,547 | A | 9/1998 | Derlinga |
| 5,979,434 | A | 11/1999 | Bilanzich |
| 6,085,768 | A | 7/2000 | Arlotta |
| 6,138,700 | A | 10/2000 | Stoddart |
| 6,453,922 | B1 | 9/2002 | Dufort |
| 6,698,440 | B2 | 3/2004 | Beyer et al. |
| 6,866,053 | B2 | 3/2005 | You |

(Continued)

FOREIGN PATENT DOCUMENTS

GB 2284437 A * 6/1995

(Continued)

OTHER PUBLICATIONS

International Search Report mailed Jan. 4, 2010 in International Application No. PCT/US2009/046607.

*Primary Examiner* — David Dunn
*Assistant Examiner* — Danielle Jackson
(74) *Attorney, Agent, or Firm* — Kenneth H. Ohriner; Perkins Coie LLP

(57) ABSTRACT

A portable sun and weather shelter is provided. The shelter comprises an umbrella foldable between open and closed positions. The umbrella has a center post, a canopy, and a frame to fold the canopy up and down. A pair of wings are attached to the perimeter edge of the canopy and can be extended outwardly beyond the canopy.

11 Claims, 5 Drawing Sheets

U.S. PATENT DOCUMENTS

| | | | |
|---|---|---|---|
| 7,240,683 | B2 | 7/2007 | Zutich |
| 7,316,239 | B2 | 1/2008 | Yang |
| 7,493,908 | B2 | 2/2009 | Carter et al. |
| 2004/0020522 | A1 | 2/2004 | James |
| 2005/0011134 | A1 | 1/2005 | Boltan et al. |
| 2009/0007947 | A1 | 1/2009 | Spangenberg |

FOREIGN PATENT DOCUMENTS

| | | | |
|---|---|---|---|
| JP | 2000093219 | A | 4/2000 |
| JP | 2003-033211 | A | 2/2003 |

* cited by examiner

PORTABLE SUN AND WEATHER SHELTER

PRIORITY CLAIM

This application is a Continuation of U.S. patent application Ser. No. 12/466,476, filed May 15, 2009, now U.S. Pat. No. 7,793,674, which claims priority to U.S. Provisional Patent Application No. 61/131,367 filed Jun. 9, 2008, both of which are incorporated herein by reference.

FIELD OF THE INVENTION

The invention is directed towards a portable shelter to protect people from the sun, wind, rain, and other weather conditions. This shelter includes wing extensions.

BACKGROUND OF THE INVENTION

Umbrellas of various designs are well-known for protecting people from rain and the sun. A hand-held umbrella typically protects one person from the elements, but normally is not large enough to protect additional people very well. Large umbrellas for providing shade are also commonly used on decks and patios. These larger umbrellas are mounted on a pole and typically include a large weight at the bottom for stability, or extend through a table so as to be supported at the base and at a point on the pole above the base. Such large umbrellas are normally set up and maintained in one place, and are not intended to be portable for traveling with a person. However, it is often desirable to have an enlarged umbrella-type shelter which can be easily folded up and down for portability and for use by two or more people for protection from the sun and rain.

Therefore, a primary objective of the present invention is the provision of a portable sun and weather shelter.

A further objective of the present invention is the provision of an umbrella shelter having a center pole, a canopy, and a frame interconnecting the pole and canopy, with a pair of wings attached to the canopy which extend outwardly beyond the canopy.

These and other objectives will become apparent from the following description of the invention.

SUMMARY OF THE INVENTION

The portable sun and weather shelter of the present invention comprises an umbrella foldable between open and closed positions. The umbrella includes a center pole, a canopy, and a frame interconnecting the pole and canopy. The shelter further includes a pair of wings or flaps attached to the canopy. The center pole may include telescoping sections.

DETAILED DESCRIPTION OF THE DRAWINGS

Figure 1:
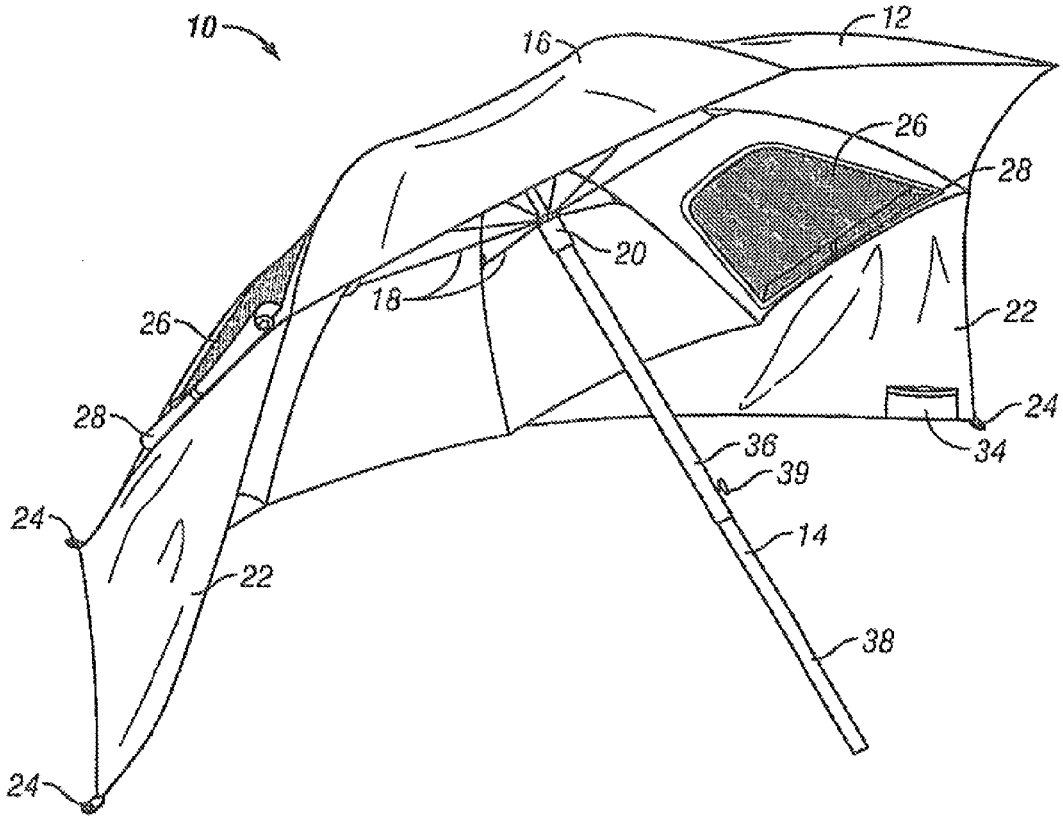
FIG. 1 is a perspective view of the portable umbrella-type sun and weather shelter resting on the ground.

The sun and weather shelter is generally designated by the reference numeral 10 in the drawings. The shelter 10 includes an umbrella 12 having a center post 14, a canopy 16, and frame members 18 extending between the canopy 16 and post 14. The outer ends of the frame members 18 are connected to the inside of the canopy 16, and the inner ends of the frame members 18 are connected to a collar 20 slideably mounted on the post 14 such that the umbrella 12 can be opened and closed in a manner similar to conventional rain umbrellas. A clip or pin (not shown) on the collar 20 engages a hole (not shown) in the post 14 so as to maintain the canopy 16 in an opened condition. A button (not shown) on the collar 20 releases the clip or pin from the hole so that the collar 20 can slide downwardly along the post 14 so as to close the canopy 16.

The shelter 10 includes a pair of wings or flaps 22 sewn, or otherwise attached in any convenient manner, to the outer periphery of the canopy 16. The wings 22 can be moved from a first position adjacent the canopy 16 to a second position extending laterally outwardly from the canopy 16.

When the umbrella 12 is opened, the canopy 16 defines a primary coverage area. When the wings 22 are opened to the extended position, the canopy 16 and wings 22 define and expanded secondary coverage area greater than the primary coverage area.

The wings or flaps 22 may include a ring 24 adapted to receive a stake (not shown) so as to secure the shelter 10 to the ground. Ring 24 may also be clipped to a clip 25 on the canopy 16 to maintain the wing 22 in the folded up or closed position.

Figure 2:
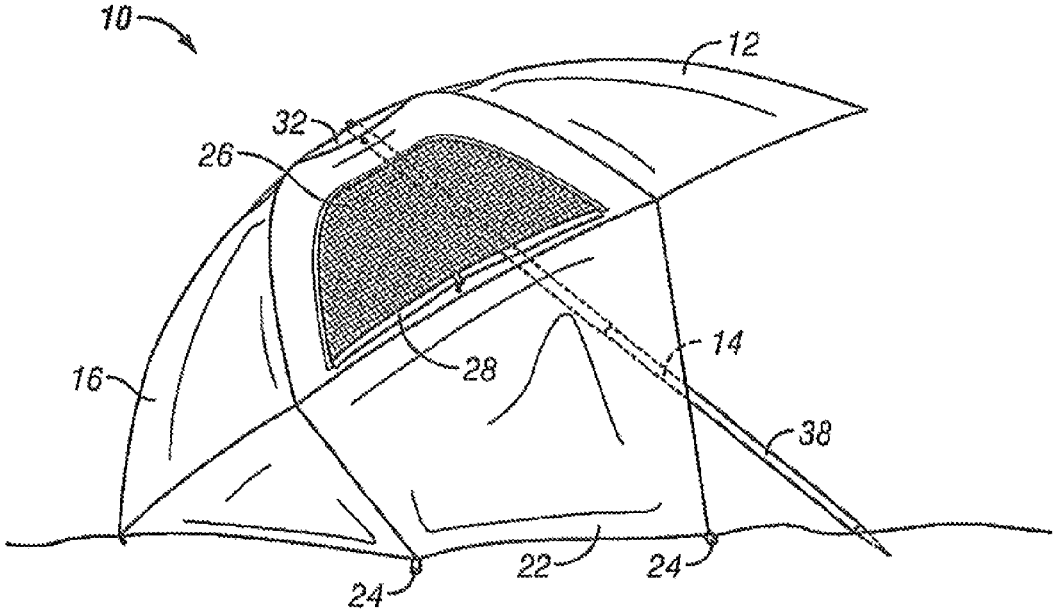
FIG. 2 is a side elevation view of the shelter.

The canopy 16 may include one or more windows for viewing through the canopy. The windows may be opaque plastic, or may be a mesh screen 26, as shown in FIGS. 1 and 2. A flap 28 is provided for covering each screen 26. The flap 28 is attached to the canopy 16 at one edge, and is moveable between a closed position covering the screen 26 and an open position exposing the screen 26. The flap 28 may be retained in the closed position in any convenient means, such as by a zipper or a Velcro® type fastening material.

Figure 4:
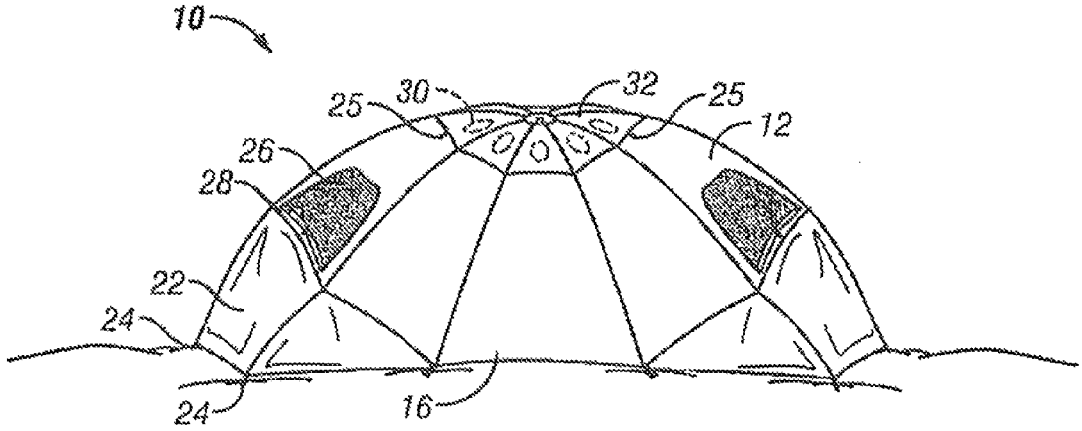
FIG. 4 is a rear elevation view of the shelter.

The canopy 16 may also include one or more wind gust vents 30, preferably adjacent the center of the canopy 16, as best seen in FIG. 4. A cap or cover 32 is provided over the vents 30 to prevent rain from passing there through.

Figure 3:
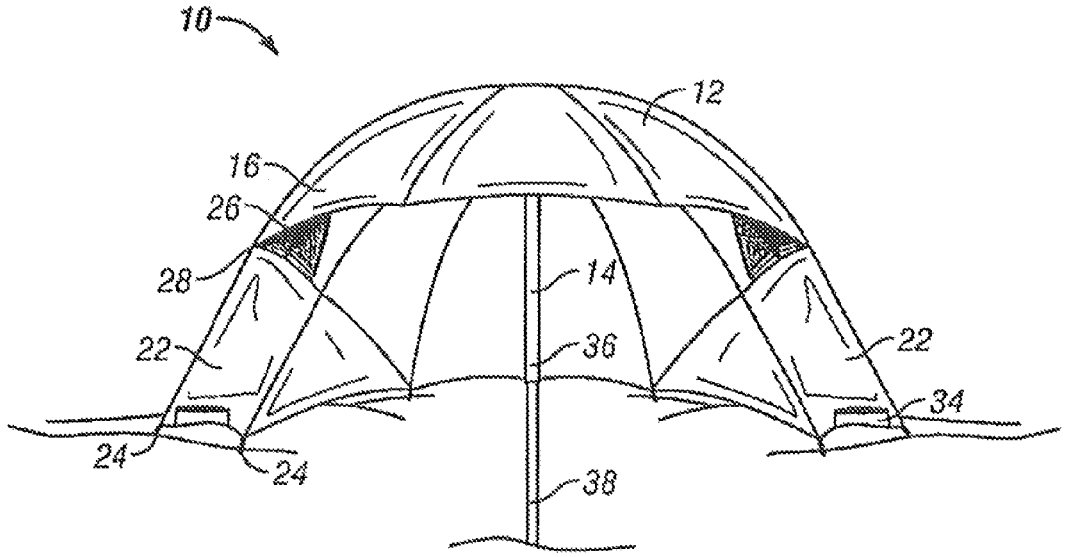
FIG. 3 is a front elevation view of the shelter

One or more storage pockets 34 may be provided in the shelter 10. For example, as seen in FIGS. 1 and 3, pockets 34 are provided in one or both of the wings 22 for storing small personal items. The pockets 34 may include a zipper or a Velcro® type closure.

The center post 14 may be formed of telescoping sections 36, 38. The lower section 38 may be extended and retracted relative to the upper section 36, with a conventional twist block action to maintain the selected positions of the sections 36, 38. Alternatively, a thumb screw 39 may be provided on the upper section 36 to maintain the lower section 38 in a selected position. Preferably, the upper section 36 has a length approximately equal to the radius of the canopy 16, so that when the umbrella 12 is folded down, the perimeter edge of the canopy 16 is adjacent the lower end of the post section 36, with the lower post section 38 being fully retracted within the upper section 36.

In use, the shelter 10 may be opened and set upon the ground, such that the lower end of the post 14 and the canopy 16 engage the ground, as shown in FIGS. 1-4. The wings 22 may be extended and staked to the ground. In this opened position, two or more people can comfortably sit beneath the canopy 16 for protection from the sun, rain, or other weather elements.

Figure 5:
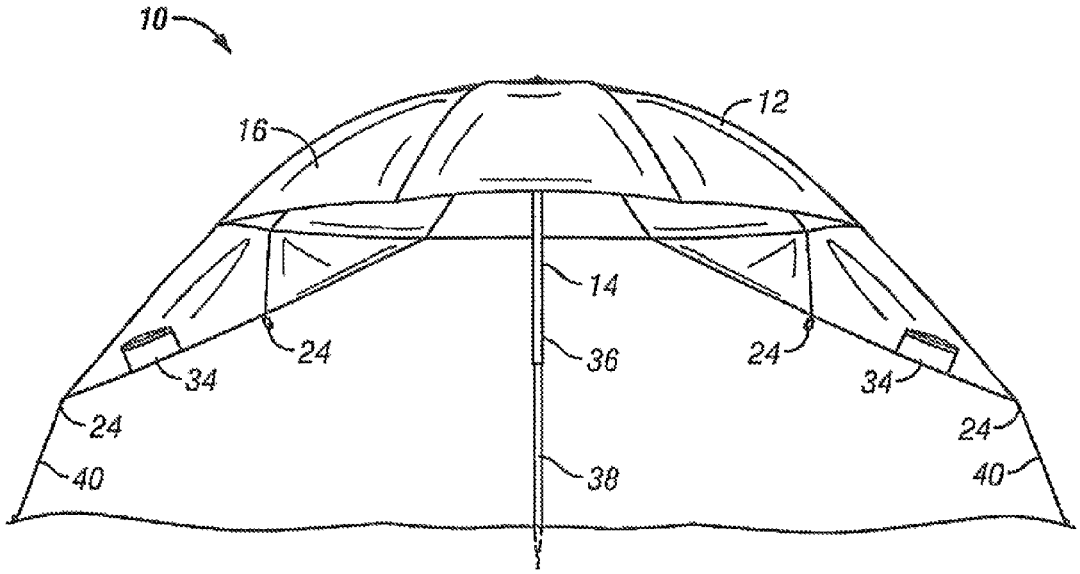
FIG. 5 is a front elevation view of the shelter with the center pole inserted into the ground and the canopy positioned above the ground.
Figure 6:
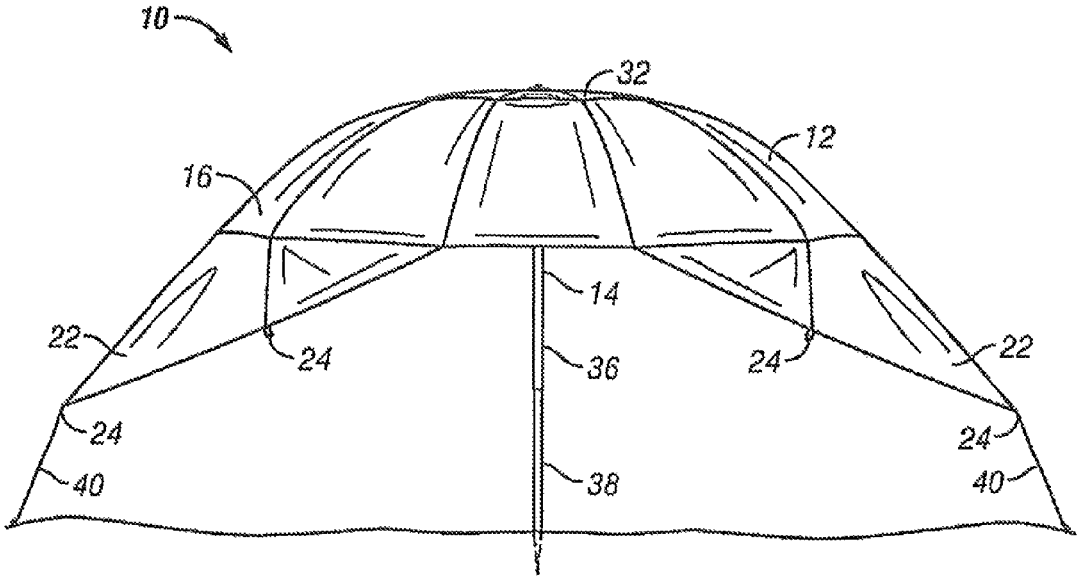
FIG. 6 is a view similar to FIG. 5 from the rear of the shelter.
Figure 7:
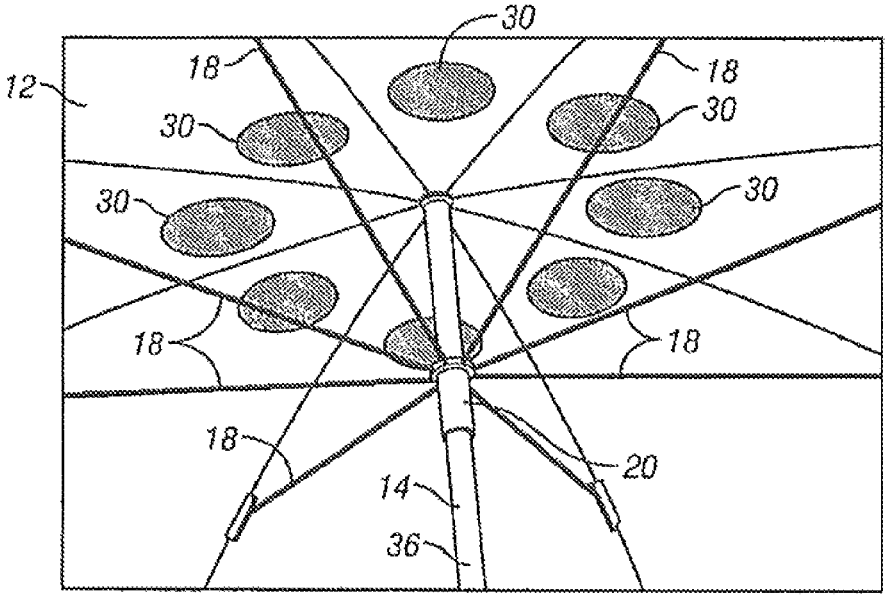
FIG. 7 is a perspective view looking upwardly into the canopy and showing the vents.

Alternatively, the shelter 10 can be stood upright, as shown in FIGS. 5 and 6, with the lower end of the post 14 engaging the ground, and a plurality of strings 40 attached to the canopy 16 and/or wings 22 and staked to the ground so as to maintain the shelter in an upright position. The lower end of the lower telescoping section 38 may be pointed so as to be pushed into the ground to further stabilize the upright shelter 10.

The shelter 10 can be folded down when not in use, and can be easily stored within a carrying bag or case (not shown) having handles for carrying the shelter 10. The bag can also hold the stakes and string for securing the shelter to the ground 10, when not in use.

The umbrella-type shelter which can be quickly and easily folded up and folded down for use by one or more people. The portable shelter can rest upon the ground or can be set upright above the ground. The portable shelter can be staked to the ground for stability.

Rings may be provided on the canopy to stake the shelter to the ground. The canopy also includes wind gust vents, and one or more windows or screens to provide visibility through the canopy. One or more storage pockets may be provided on the wings. The underside of the canopy includes a metallic coating for enhanced protection from the sun. The wings can be folded against the canopy and maintained by clips, or can be folded outwardly from the canopy for expanded protection from the weather.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

The invention claimed is:

1. A portable shelter, comprising:

an umbrella foldable between open and closed positions, the umbrella including a pole and a canopy, a collar slidably positioned on the pole, and a plurality of frames connected to the collar and to the canopy;

the canopy including a plurality of outer edges forming a polygon, including first, second, third, fourth and fifth outer edges;

a left flap permanently attached to the first and second outer edges of the canopy;

a right flap permanently attached to the fourth and fifth outer edges of the canopy, with the third outer edge between the second and fourth outer edges, the left flap spaced apart from the right flap, and with the third and any other outer edges of the polygon being free edges.

2. The portable shelter of claim 1 wherein the outer edges of the polygon are of equal length.

3. The portable shelter of claim 1 and with the left and right flaps extending from the canopy substantially to the ground when the canopy is set on the ground with the second outer edge of the canopy substantially in contact with the ground, and with the pole at an acute angle to the ground.

4. A portable shelter, comprising:

an umbrella foldable between open and closed positions, the umbrella including a pole and a canopy, a collar slidably positioned on the pole, and first, second, third, fourth, fifth, sixth, seventh and eighth frames connected to the collar and to the canopy;

the portable shelter having only a first flap and a second flap, with the first flap permanently attached to a perimeter of the canopy between the first and the third frames and the second flap permanently attached to a perimeter of the canopy between the sixth and the eighth frames, the first and second flaps each having only three sides; and with the first and second flaps extending from the canopy substantially to the ground when the canopy is set on the ground with the pole at an acute angle to the ground.

5. The portable shelter of claim 4 with the canopy having an outer free edge between the eighth frame and the first frame, and between the third and fourth frames, the fourth and fifth frames, and the fifth and sixth frames.

6. The portable shelter of claim 4 wherein the canopy has eight sides.

7. The portable shelter of claim 4 with the first and second flaps each having a substantially horizontal lower edge when the pole is at an acute angle to the ground.

8. The portable shelter of claim 4 with the first and second flaps extending from the canopy substantially to the ground when the canopy is set on the ground with the outer free edge of the canopy between the eighth and first frames in contact with the ground, and with the pole at an acute angle to the ground.

9. A portable shelter, comprising:

an umbrella including a pole and a canopy, a collar slidably positioned on the pole, and a plurality of frames connected to the collar and to the canopy;

the canopy including a plurality of outer edges forming a polygon having multiple sides including first, second and third sides;

a first flap attached to the first side of the polygon;

a second flap attached to the third side of the polygon, with the third side of the polygon not adjoining the first side of the polygon, so that the first flap is spaced apart from the second flap, the first and second flaps each having only three sides;

the first and second flaps hanging down from the canopy substantially only to the ground when the shelter is set on the ground, and the second side of the polygon adjacent to the ground, when the canopy is set on the ground with the pole at an acute angle to the ground.

10. A portable shelter, comprising:

an umbrella foldable between open and closed positions, the umbrella including a pole and a canopy, a collar slidably positioned on the pole, and a plurality of frames connected to the collar and to the canopy;

the canopy including a plurality of outer edges forming a polygon, including first, second, third, fourth and fifth outer edges;

a left flap attached to the first and second outer edges of the canopy;

a right flap attached to the fourth and fifth outer edges of the canopy, with the third outer edge between the second and fourth outer edges, and the left flap spaced apart from the right flap; and the left and right flaps extending from the canopy substantially to the ground when the canopy is set on the ground with the second outer edge of the canopy substantially in contact with the ground, and with the pole at an acute angle to the ground.

11. A portable shelter, comprising:

an umbrella foldable between open and closed positions, the umbrella including a pole and a canopy, a collar slidably positioned on the pole, and first, second, third, fourth, fifth, sixth, seventh and eighth frames connected to the collar and to the canopy;

a first flap attached to a perimeter of the canopy between the first and the third frames;

a second flap attached to a perimeter of the canopy between the sixth and the eighth frames;

the first and second flaps extending from the canopy substantially to the ground when the canopy is set on the ground with the pole at an acute angle to the ground and with the outer free edge of the canopy between the eighth and first frames substantially in contact with the ground.

* * * * *